US009276328B2

(12) United States Patent
Chen et al.

(10) Patent No.: US 9,276,328 B2
(45) Date of Patent: Mar. 1, 2016

(54) SMALL-CALIBER, HIGH-PERFORMANCE BROADBAND RADIATOR

(71) Applicants: Peng Chen, Hsinchu (TW); Xiao-Liu Du, Hsinchu (TW); Yu Wang, Hsinchu (TW); Yan-Kui Su, Hsinchu (TW)

(72) Inventors: Peng Chen, Hsinchu (TW); Xiao-Liu Du, Hsinchu (TW); Yu Wang, Hsinchu (TW); Yan-Kui Su, Hsinchu (TW)

(73) Assignee: WHA YU INDUSTRIAL CO., LTD., Hsinchu (TW)

( * ) Notice: Subject to any disclaimer, the term of this patent is extended or adjusted under 35 U.S.C. 154(b) by 179 days.

(21) Appl. No.: 14/147,873

(22) Filed: Jan. 6, 2014

(65) Prior Publication Data

US 2015/0194739 A1 Jul. 9, 2015

(51) Int. Cl.

| | |
|---|---|
| ***H01Q 21/26*** | (2006.01) |
| *H01Q 1/24* | (2006.01) |
| *H01Q 21/08* | (2006.01) |

(52) U.S. Cl.

CPC ..... *H01Q 21/26* (2013.01); *H01Q 1/246* (2013.01); *H01Q 21/08* (2013.01)

(58) Field of Classification Search

CPC ..... H01Q 21/26; H01Q 21/061; H01Q 21/08; H01Q 1/246

USPC ..... 343/798, 799

See application file for complete search history.

(56) References Cited

U.S. PATENT DOCUMENTS

| | | | | |
|---|---|---|---|---|
| 8,760,356 | B2 * | 6/2014 | Bu et al. | 343/799 |
| 8,957,823 | B2 * | 2/2015 | Lee et al. | 343/795 |

* cited by examiner

*Primary Examiner* — Hoang V Nguyen

(74) *Attorney, Agent, or Firm* — Egbert Law Offices, PLLC

(57) ABSTRACT

A small-caliber, high-performance broadband radiator allows two unit arms of the first and second group of dipoles to be folded inwards, an included angle of 40°-50° is formed between two unit arms of the first/second groups of dipoles and the first/second unit racks, and the unit arms of the first and second groups of dipoles are arranged linearly at interval while flexural loading sections are provided and also connected by dielectric medium. Hence, the broadband radiator allows significant reduction of the aperture of the broadband radiator, and there is a larger adjustment space for the gap of the radiator array, so the interference of low and high bands is less. This allows for improved performance, thus reducing the configuration size and manufacturing cost of antennas, and creating better industrial benefits with improved applicability.

4 Claims, 8 Drawing Sheets

SMALL-CALIBER, HIGH-PERFORMANCE BROADBAND RADIATOR

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an antenna, and more particularly to an innovative one which is designed with a small-caliber, high-performance broadband radiator.

2. Description of Related Art Including Information Disclosed Under 37 CFR 1.97 and 37 CFR 1.98.

According to the structural embodiments of existing broadband antennas or dual-band antennas, high and low band antennas are arranged coaxially, and also distributed in arrays to realize expected performance.

FIG. 1 depicts a plane top view of a conventional broadband antenna, which is of an array antenna structure formed by broadband radiator units 60 together with broadband radiators 70. The broadband radiator 70 consist of two dipoles 71, 72 in pair, and equilibrators 73 are used to support securely two dipoles 71, 72 at interval on a long substrate 80. The equilibrators 73 are protruded upwards in an x-frame pattern, comprising of first unit racks 731 and second unit racks 732 orthogonally to each other. A 45° included angle is formed between the setting direction of the first and second unit racks 731, 732 and the extension of the long substrate 80, then the first group of dipoles 71 are separately set at two protruding ends of the first unit rack 731, while the second group of dipoles 72 are separately set at two protruding ends of the second unit rack 732. Moreover, an orthogonal relation is formed between the setting directions of both the first group of dipoles 71 and the first unit rack 731 (90° included angle as shown by X1), meanwhile an orthogonal relation is also formed between the setting directions of both the second group of dipoles 72 and the second unit rack 732 (90° included angle as shown by X2). A 180° included angle is formed between two unit arms of the first group of dipoles 71 and second group of dipoles 72 (straight arm pattern as shown by X3). Hence, the overall dipole structure is of a diamond-shaped framework over the long substrate 80. Referring to FIG. 1, when multiple radiator units are distributed along the extension of the long substrate 80 in an elongated array pattern, the diamond-shaped dipoles 71, 72 of various radiator units are aligned by their sharp corners. However, a number of shortcomings are still observed during actual applications.

Due to a larger aperture of the broadband radiator 70 (diamond-shaped framework formed by the dipoles), the cross-polarization of high or low band antennas will deteriorate, leading to gain reduction. On the other hand, as there lacks a bigger adjustment space for the array gap of the broadband radiator 70 (indicated by L1), the interference and negative influence of the low and high band antennas will increase. If said array gap is enlarged, the extension space of the antennas will be increased substantially, leading to sharp increase of the antenna fabrication cost with lower economic efficiency and greater space occupancy.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

Based on the unique characteristics of the present invention wherein said "small-caliber, high-performance broadband radiator" allows two unit arms of the first and second group of dipoles to be folded inwards, an included angle of 40°-50° is formed between two unit arms of the first/second groups of dipoles and the first/second unit racks, and the unit arms of the first and second groups of dipoles are arranged linearly at interval while flexural loading sections are provided and also connected by dielectric medium. Hence, the present invention allows for a great reduction of the aperture of the broadband radiator, and there is a bigger adjustment space for the gap of the radiator array, so the interference of low and high bands is lesser, the performance could be improved significantly, thus reducing the configuration size and manufacturing cost of antennas, and creating better industrial benefits with improved applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
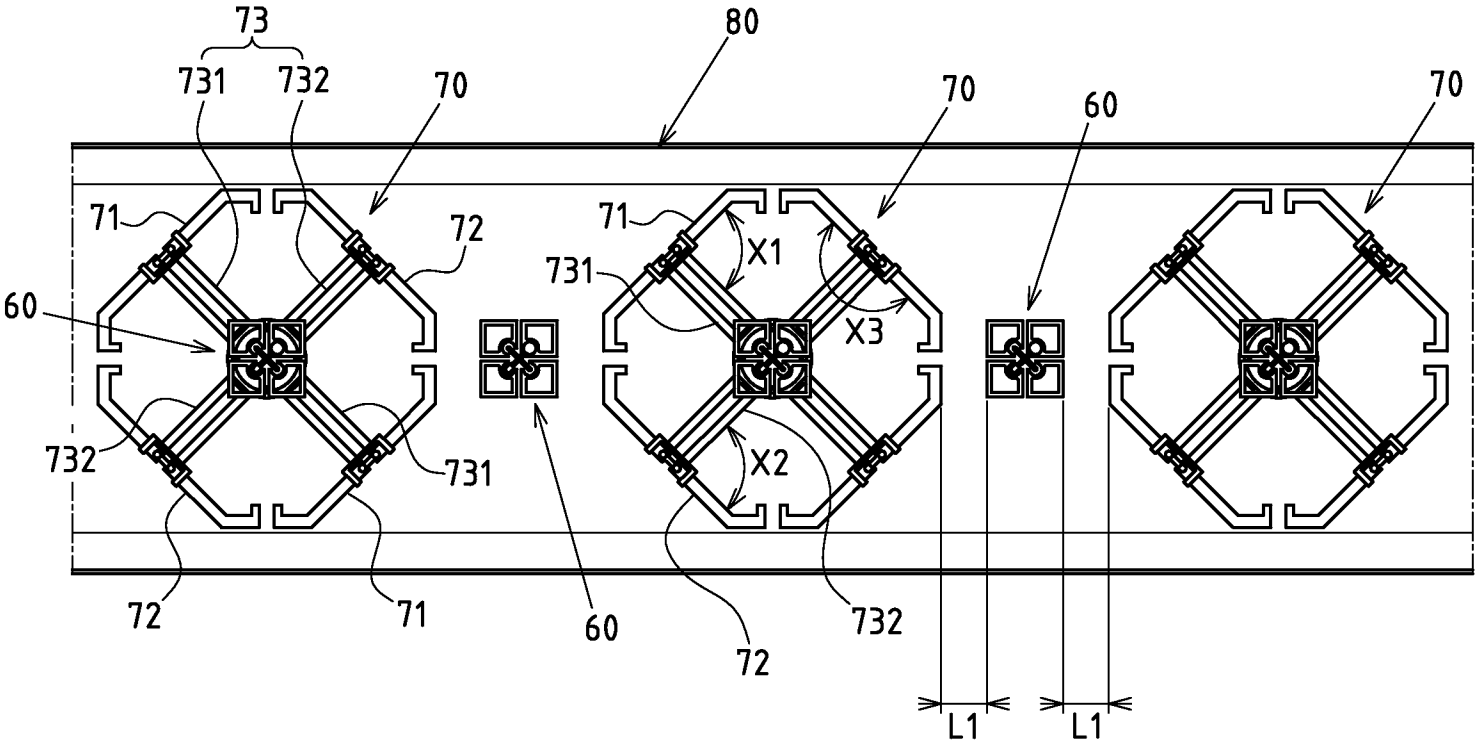
FIG. 1 is a plane top view of a conventional antenna.

FIGS. 2-7 depict preferred embodiments of a small-caliber, high-performance broadband radiator of the present invention, which, however, are provided for only explanatory objective for patent claims.

Said small-caliber, high-performance broadband radiator A comprises two dipoles 11, 12 set in pair (roughly a square pattern), and equilibrators 20 used to support securely two dipoles 11, 12. The equilibrators 20 are protruded upwards in an x-frame pattern, comprising of first unit racks 21 and second unit racks 22 orthogonally to each other as well as a pedestal 23 (either round or square) used to connect the first and second unit racks 21, 22. Both the first group of dipoles 11 and second group of dipoles 12 consist of two unit arms 113, 123 and a mating portion 114 (or 124) located between two unit arms 113 (or 123). Of which, the first group of dipoles 11 are set at two protruding ends of the first unit racks 21 via the mating portion 114, while the second group of dipoles 12 are set at two protruding ends of the second unit racks 22 via the mating portion 124.

The present invention is characterized by that two unit arms 113, 123 of the first group of dipoles 11 and second group of dipoles 12 are folded inwards. An included angle of 400-50° is formed between two unit arms 113 of the first group of dipoles 11 and the first unit racks 21 (indicated by X4 in FIG. 4), while an included angle of 40°-50° is formed between two unit arms 123 of the second group of dipoles 12 and the second unit racks 22 (indicated by X5 in FIG. 4). The unit arms 113 of the first group of dipoles 11 and the unit arms 123 of the second group of dipoles 12 are spaced at intervals, and flexural loading sections 115, 125 are set at ends of the unit arms 113, 123. The flexural loading sections 115, 125 set oppositely are connected by an insulated dielectric medium 30, which enables the unit arms 113, 123 to maintain appropriate bandwidth performance in the state of reduced length.

Figure 2:
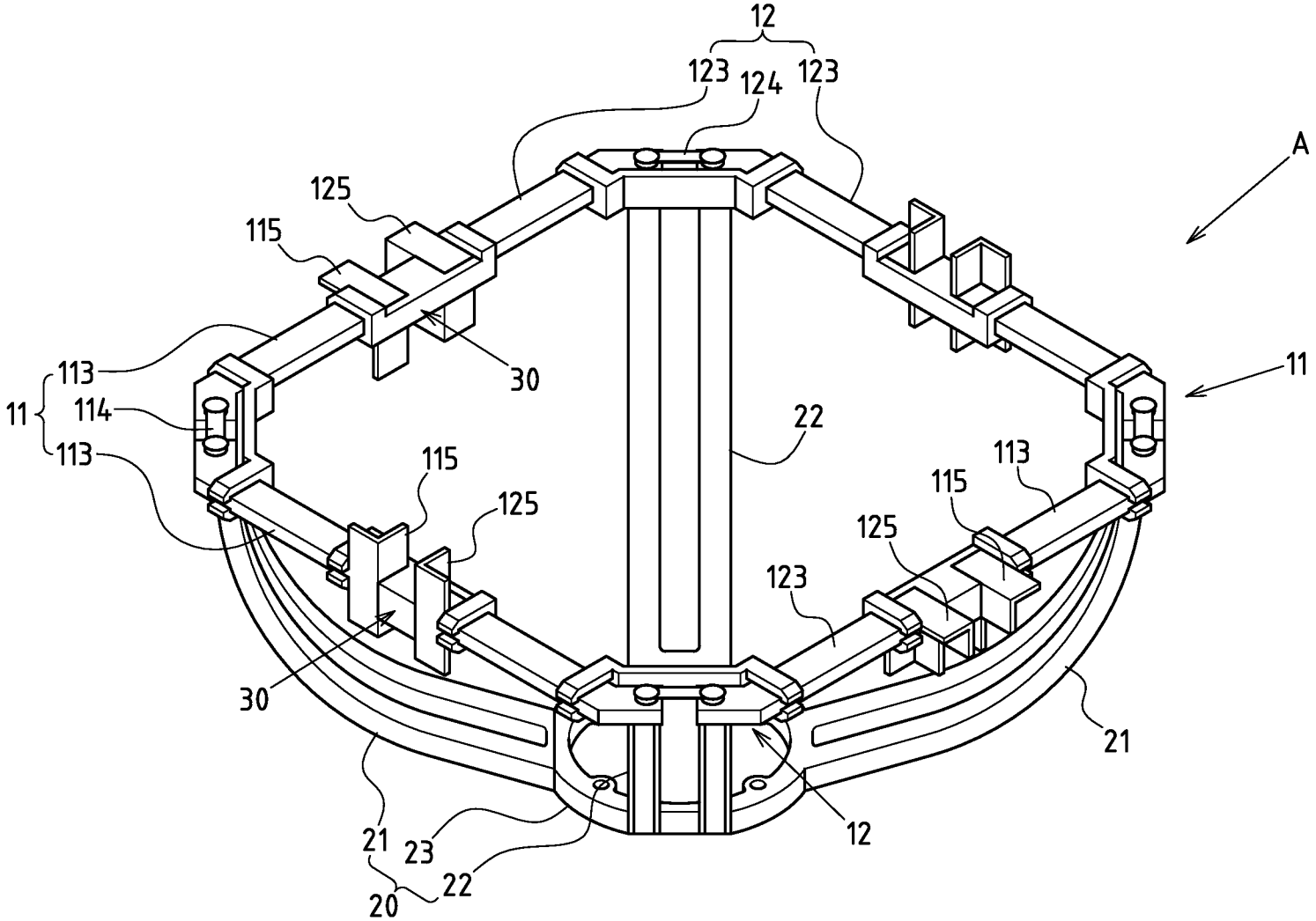
FIG. 2 is a perspective view of the preferred embodiment of the present invention.
Figure 3:
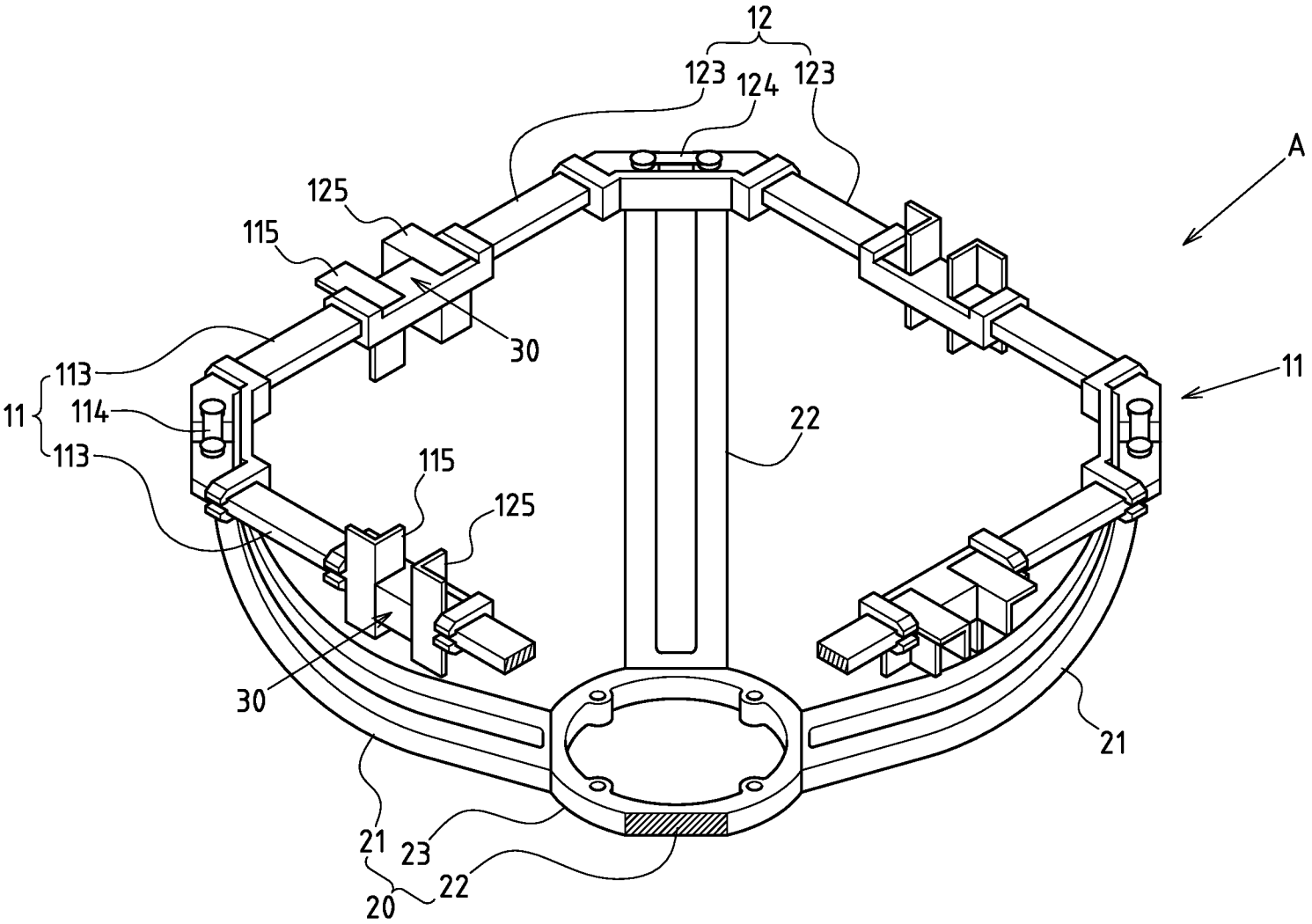
FIG. 3 is a partial sectional status view of FIG. 2 for the preferred embodiment of the present invention.
Figure 4:
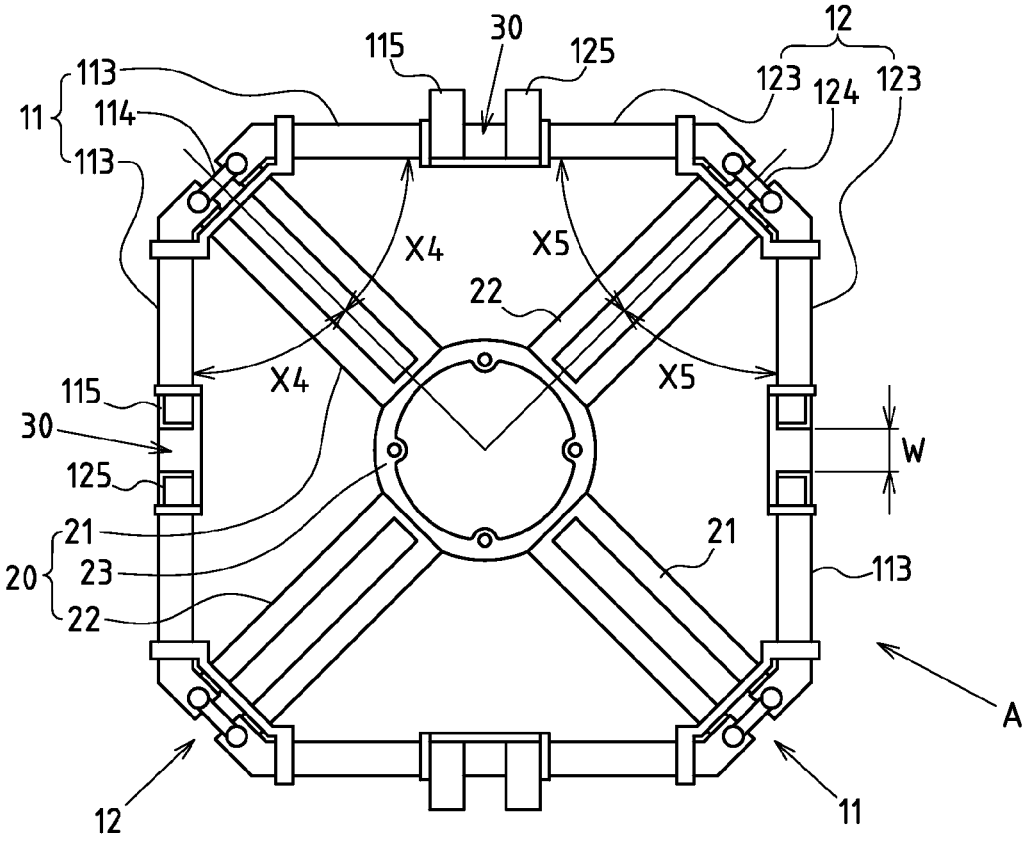
FIG. 4 is a plane top view of the preferred embodiment of the present invention.

Of which, the flexural loading sections 115 (or 125) set oppositely are folded equidirectionally or symmetrically. Or, the flexural loading sections 115 (or 125) set adjacently (e.g.: forwards versus rightwards, backwards versus leftwards) are folded inversely. Referring to FIGS. 2-4: the flexural loading sections 115, 125 set at ends of the unit arms 113, 123 in front of and behind (opposite to each other) the small-caliber, high-performance broadband radiator A are folded outwards symmetrically, while the flexural loading sections 115, 125 set at ends of the unit arms 113, 123 at left/right hands (opposite to each other) the small-caliber, high-performance broadband radiator A are folded upwards or downwards (or vertically).

Referring to FIG. 4, the spacing (W) between the unit arms 113 of the first group of dipoles 11 and the unit arms 123 of the second group of dipoles 12 is of 0.4-0.6 wavelength of the central working frequency.

Figure 6:
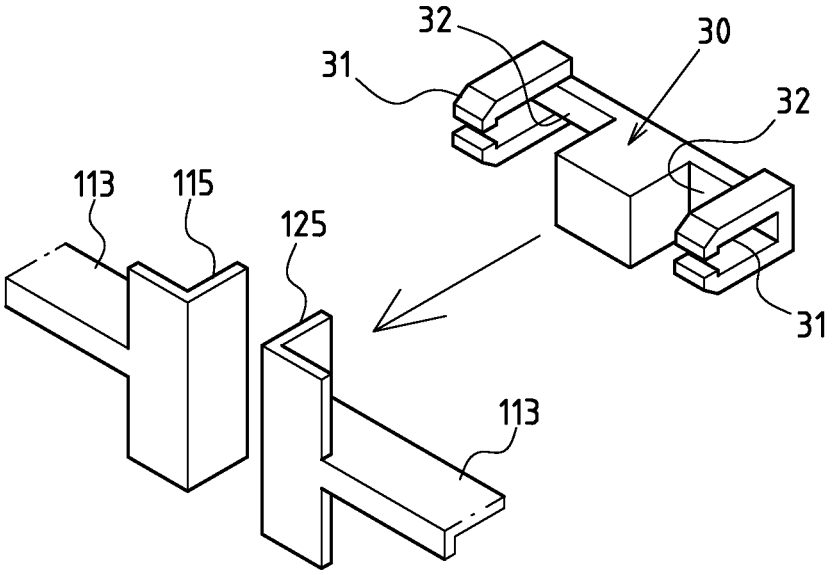
FIG. 6 is an exploded perspective view of a preferred embodiment of the flexural loading section and dielectric medium of the present invention.
Figure 7:
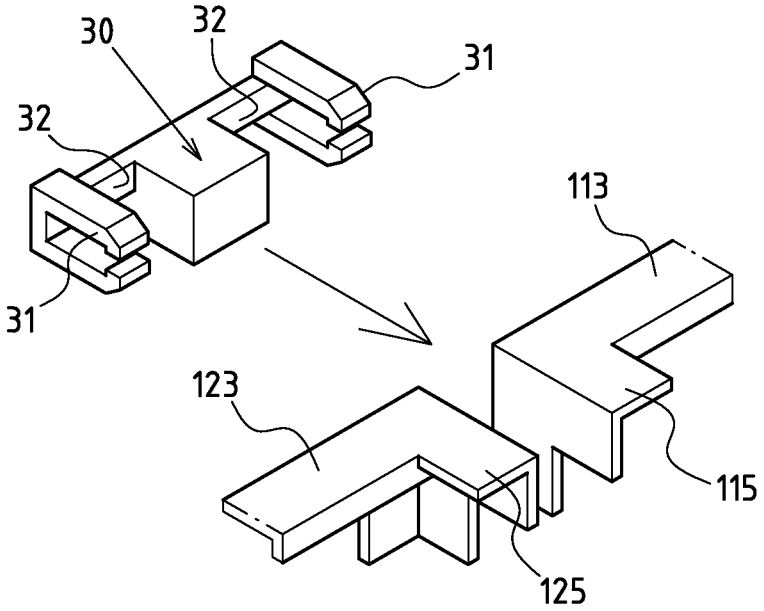
FIG. 7 is an exploded perspective view of another preferred embodiment of the flexural loading section and dielectric medium of the present invention.

Referring to FIGS. 6 and 7, two claws 31 are set at two opposite ends of the dielectric medium 30, and two grooves 32 are formed between the dielectric medium 30 and two claws 31. Said dielectric medium 30 is used for abutting of the flexural loading sections 115 (or 125) at the ends of the unit arms 113 (or 123), said groove 32 is used for embedding of the flexural loading sections 115 (or 125), and said claw 31 is used for clamping at said unit arm 113 (or 123). Also, said dielectric medium 30 is made of high-k medium (e.g.: POM), which is used to offset the inductance/capacitance effect of radiator and expand its bandwidth.

Figure 8:
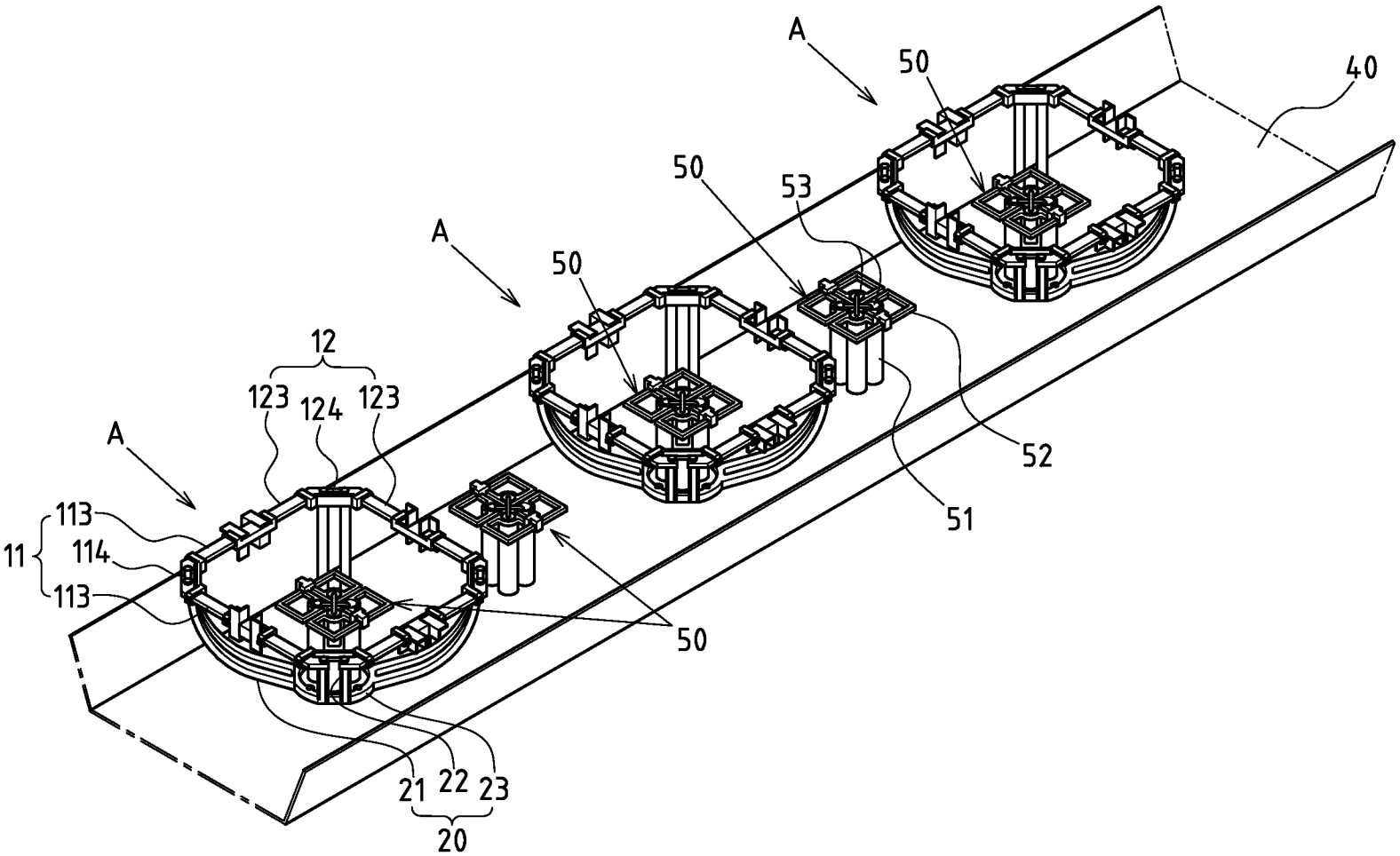
FIG. 8 is a perspective view of the application pattern of the present invention.
Figure 9:
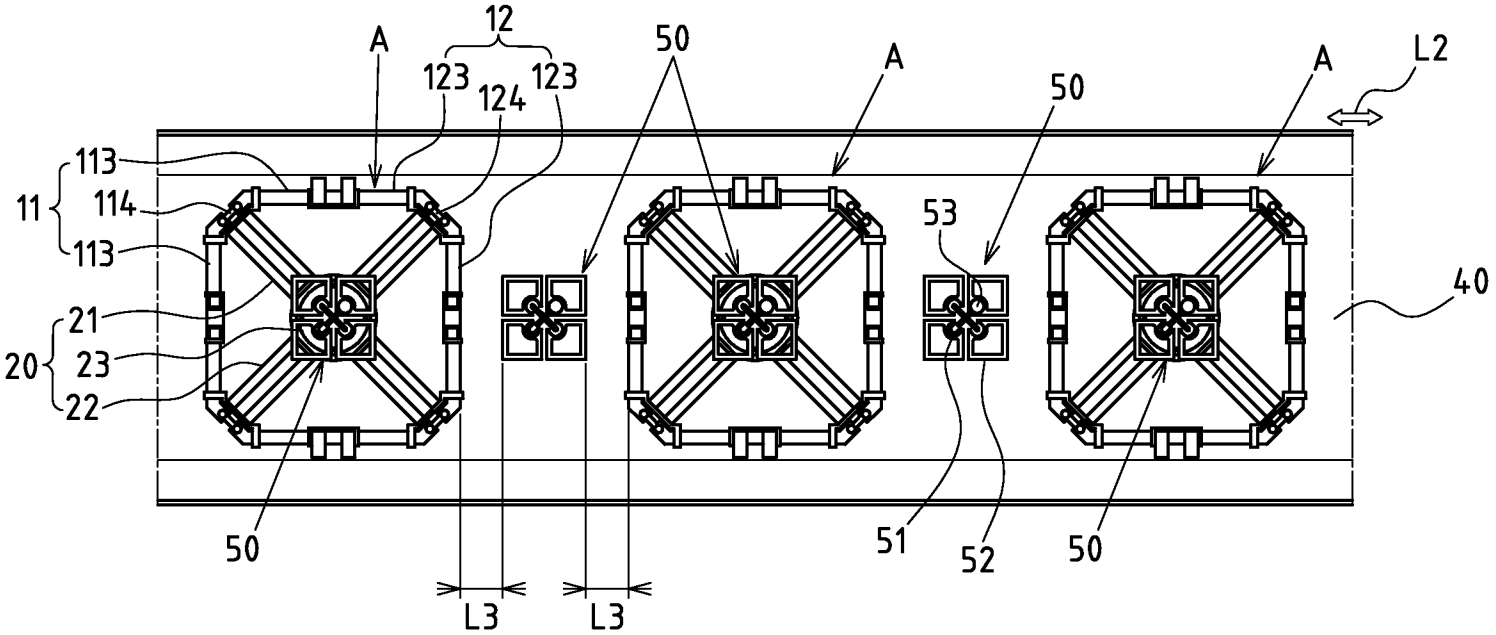
FIG. 9 is a plane top view of the application pattern of the present invention.

Referring to FIGS. 8 and 9, said pedestal 23 is assembled securely on the long substrate 40 of an array antenna, and a 45° included angle is formed between the first unit rack 21 and the extension of the long substrate 40 (indicated by L2 in FIG. 9); a 45° included angle is formed in opposite direction between the setting direction of second unit racks 22 and the extension of the long substrate 40 (indicated by L2 in FIG. 9). Moreover, a unit radiator 50 is separately arranged on the pedestal 23 within the range formed by two dipoles 11, 12, as well as at two opposite sides of said small-caliber, high-performance broadband radiator. Said unit radiator 50 comprises of a vertical support 51 and four radiator arms 52 transversely set at top of said vertical support 51 in contour configuration; said radiator arms 52 form two groups of orthogonal half-wave radiators, and the spacing of two adjacent radiator arms 52 is equal; besides, a feeding socket 53 is vertically set on the vertical support 51 for connecting to various radiator arms 52.

In the aforementioned preferred embodiments, the overall structural design allows the high and low band antennas to be coaxially set, and the influence between two frequency bands could be reduced markedly, thus improving greatly the performance of the high and low band antennas.

Figure 5:
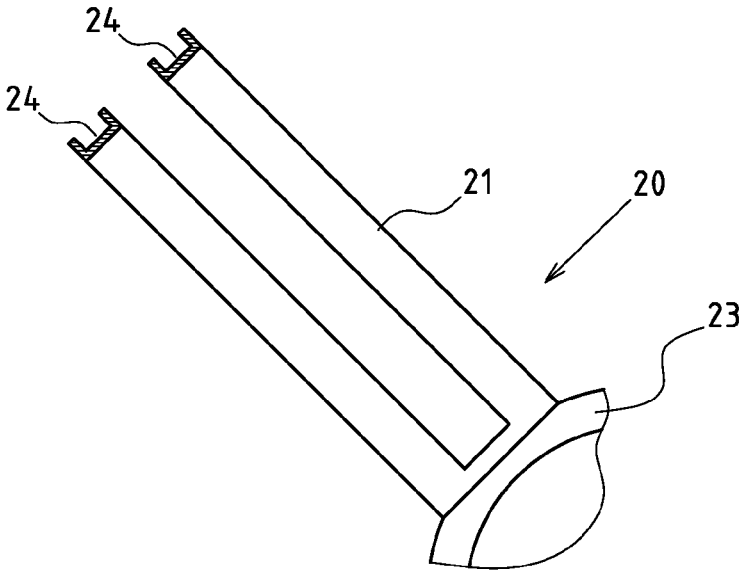
FIG. 5 is a schematic view of the present invention wherein cabling slots are set externally onto the unit racks.

Referring to FIG. 5, cabling slots 24 are set externally onto the first unit rack 21 and second unit rack 22 of said equilibrator 20 (in collaboration with FIG. 4), allowing to embed securely existing feed cables (not shown in the figure). Said cabling slots 24 could provide a protective cover to the current in the feed cables.

Figure 10:
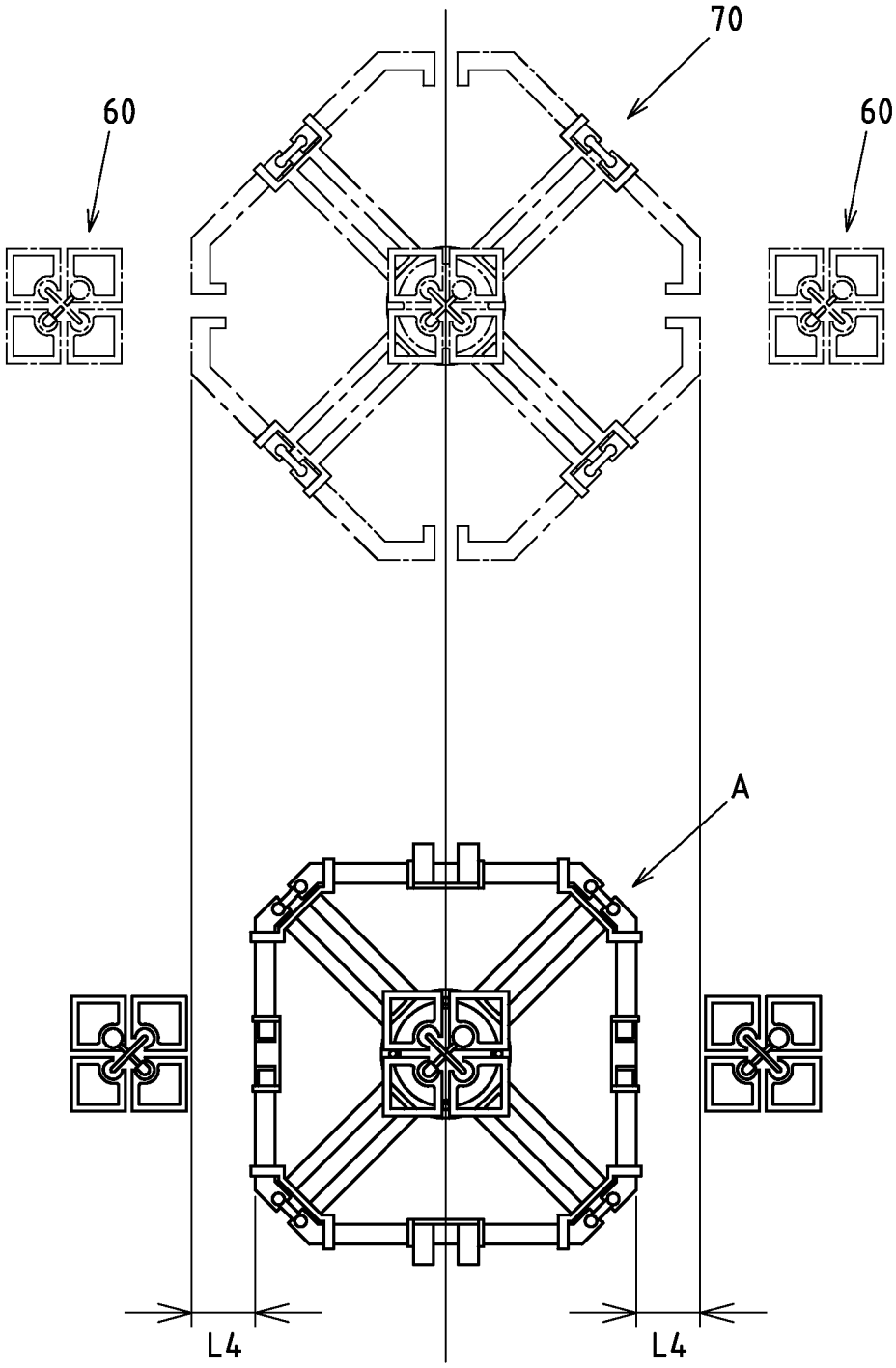
FIG. 10 is an abbreviated view of the present invention enabling reduction of radiator aperture.

Based upon above-specified structural design, the present invention is operated as follows:

Referring to FIGS. 2, 3 and 4, the core design of the small-caliber, high-performance broadband radiator A of the present invention lies in that, two unit arms 113, 123 of the first group of dipoles 11 and second group of dipoles 12 are folded inwards, so that an included angle of 40°-50° is formed between two unit arms 113 of the first group of dipoles 11 and the first unit racks 21 (indicated by X4 in FIG. 4), while an included angle of 40°-50° is formed between two unit arms 123 of the second group of dipoles 12 and the second unit racks 22 (indicated by X5 in FIG. 4). As for two unit arms 113 (or 123) of same groups, the included angle is of 80-100° (preferably 90°). As compared with the prior art, the present invention enables great reduction of the aperture of the entire radiator. The aperture referred hereto indicates in fact the extended width in relation to the long substrate 40. Referring to FIG. 10, if the conventional broadband radiator 70 is compared with said small-caliber, high-performance broadband radiator A of the present invention, it is found that, the square dipoles of the present invention are arranged oppositely by their straight sides, but the diamond-shaped dipoles are aligned by their sharp corners; hence, the reduced aperture width is as much as that shown in L4, thus overcoming the shortcomings such as deteriorating cross-polarization and gain reduction of high or low band antennas arising from a larger aperture. Moreover, due to substantial reduction of the radiator aperture, there is a bigger adjustment space for the gap of the radiator array (indicated by L3 in FIG. 9), even though the length and size of the antennas after widening is still equivalent to the conventional design; moreover, the interference of low and high bands is smaller, the performance could be improved significantly, and the configuration size of small-caliber, high-performance broadband radiator A could be ameliorated due to the lower aperture of low band radiator and the optimized gap of the high band antenna array. Said equilibrator 20 is used to equilibrate power feed to the first group of dipoles 11 and second group of dipoles 12. On the other hand, based on the technical characteristics of the present invention wherein said unit arms 113 and 123 are folded inwards in collaboration with the flexural loading sections 115, 125, the aperture of the radiator could be reduced significantly, and the performance of double-/multiple band antennas could be further improved.

Additionally: the technical characteristics of the "small-caliber, high-performance broadband radiator" of the present invention are not implemented by only 45° rotation of the conventional broadband radiator. In such a case, the x-frame pattern of the equilibrator 73 will be turned into a crisscross pattern, thus leading to loss of original cross-polarization property (note: the transmitting/receiving performance of antenna differ significantly).

We claim:

1. A small-caliber, high-performance broadband radiator comprising:

two groups of dipoles set in pairs;

a plurality of equilibrators securely supporting said two groups dipoles, the equilibrators protruding upwards in an x-frame pattern, the equilibrators comprising a first unit rack and a second unit rack and a pedestal, said first unit rack and said second unit rack arranged orthogonal to each other, said pedestal connecting said first and second unit racks, each of the groups of dipoles comprising two unit arms and a mating portion located between two unit arms, one of said two groups of dipoles positioned at two protruding ends of said first unit rack via said mating portion, another of said two groups of dipoles positioned at two protruding ends of said second unit rack via the mating portion, said two unit arms of said two groups of dipoles being folded inwardly, an included angle of 40°-50° being formed between said two unit arms of said one of said two groups of dipoles and said first unit rack, an included angle of 40°-50° is formed between said two unit arms of said another of said two groups of dipoles and said second unit rack, the unit arms of said one of said two groups of dipoles and the unit arms of said another of said two groups of dipoles between spaced apart, each of the unit arms having a flexural loading section at an end thereof, the flexural loading sections that are opposite to each other are connected by an insulated dielectric medium so as to allow the unit arms to maintain an appropriate bandwidth performance, the flexural loading sections that are opposite to each other are folded equidirectionally or symmetrically or the flexural loading sections that are adjacent each other are folded inversely.

2. The broadband radiator of claim 1, a spacing between the unit arms of said one of said two groups of dipoles and the unit arms of said another of said two groups of dipoles is of a 0.4-0.6 wavelength of the central working frequency.

3. The broadband radiator of claim 2, said dielectric medium having a pair of claws positioned at opposite end thereof, a pair of grooves are formed respectively between said dielectric medium and said pair of claws, said dielectric medium butting the flexural loading sections at the ends of the unit arms, said flexural loading section embedded in the groove, the claw clamping onto the unit arm, said dielectric medium formed of high-k medium.

4. The broadband radiator of claim 3, said pedestal being installed onto an elongated substrate of an array antenna, a 45° included angle being formed between said first unit rack and said elongate substrate, another 45° included angle being formed in an opposite direction between said second unit racks and said elongate substrate, a unit radiator being arranged separately on said pedestal, said unit radiator having a vertical support and four radiator arms transversely positioned in a contoured configuration at a top of said vertical support, said radiator arms forming two groups of orthogonal half-wave radiators in which a spacing of between two adjacent radiator arms is equal, said vertical support having a feeding socket vertically positioned thereon so as to connect to the radiator arms.

* * * * *